US012454786B2

(12) United States Patent
Jung et al.

(10) Patent No.: US 12,454,786 B2
(45) **Date of Patent: *Oct. 28, 2025**

(54) WASHING MACHINE

(71) Applicant: SAMSUNG ELECTRONICS CO., LTD., Suwon-si (KR)

(72) Inventors: Hyun Dong Jung, Suwon-si (KR); Nae Young Park, Seoul (KR); Seung-Mok Lee, Suwon-si (KR); Young-Seong Cheon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 197 days.

This patent is subject to a terminal disclaimer.

(21) Appl. No.: 18/209,591

(22) Filed: Jun. 14, 2023

(65) Prior Publication Data

US 2023/0323588 A1 Oct. 12, 2023

Related U.S. Application Data

(63) Continuation of application No. 16/303,380, filed as application No. PCT/KR2017/012664 on Nov. 9, 2017, now Pat. No. 11,713,533.

(30) Foreign Application Priority Data

Dec. 23, 2016 (KR) ..... 10-2016-0178547

(51) Int. Cl.
*D06F 39/08* (2006.01)
*D06F 31/00* (2006.01)
(Continued)

(52) U.S. Cl.
CPC ..... *D06F 39/088* (2013.01); *D06F 31/00* (2013.01); *D06F 39/02* (2013.01); *D06F 39/08* (2013.01); *D06F 37/42* (2013.01); *D06F 39/081* (2013.01)

(58) Field of Classification Search
CPC ..... D06F 31/00; D06F 39/02; D06F 39/022; D06F 23/04; D06F 39/088; F16K 15/06
See application file for complete search history.

(56) References Cited

U.S. PATENT DOCUMENTS

2011/0120196 A1* 5/2011 Kim ..... D06F 39/02 222/416
2015/0068622 A1* 3/2015 Andersson ..... F16K 17/12 137/533.21

(Continued)

FOREIGN PATENT DOCUMENTS

EP 2360309 A1 8/2011
JP 2014-42697 3/2014

(Continued)

OTHER PUBLICATIONS

KR20150091935A Machine Translation (Year: 2015).*

(Continued)

*Primary Examiner* — Spencer E. Bell
(74) *Attorney, Agent, or Firm* — STAAS & HALSEY LLP

(57) ABSTRACT

A washing machine is disclosed. The washing machine include a first housing, a second housing arranged above the first housing, a first tub covered by the first housing, a second tub covered by the second housing, and a first detergent supplier arranged to supply a detergent to the first tub, a second detergent supplier having a first supply assembly arranged to supply a detergent to the second tub by siphonage when water for laundry is being supplied, wherein the first supply assembly comprises a first valve device arranged in a detergent supply path, in which a detergent is moved to the second tub, for preventing water for laundry from flowing backwards by buoyancy.

11 Claims, 10 Drawing Sheets

(51) Int. Cl.
*D06F 37/42* (2006.01)
*D06F 39/02* (2006.01)

(56) References Cited

U.S. PATENT DOCUMENTS

| | | | | |
|---|---|---|---|---|
| 2015/0252514 | A1* | 9/2015 | Seo | D06F 33/37 68/17 R |
| 2016/0327169 | A1* | 11/2016 | Yazykov | F16K 15/06 |
| 2016/0334026 | A1* | 11/2016 | Wadhwani | F16K 15/021 |
| 2018/0171534 | A1* | 6/2018 | Chae | A47L 15/44 |
| 2018/0282931 | A1 | 10/2018 | Kim | |

FOREIGN PATENT DOCUMENTS

| | | | | |
|---|---|---|---|---|
| KR | 10-0927894 | | 11/2009 | |
| KR | 10-1306723 | | 9/2013 | |
| KR | 10-1403957 | | 5/2014 | |
| KR | 2015091935 | A * | 8/2015 | |
| KR | 20150091935 | A | 8/2015 | |
| KR | 10-2016-0092453 | | 8/2016 | |
| WO | WO-2005106101 | A | 11/2005 | |
| WO | WO-2005106101 | A1 * | 11/2005 | D06F 39/02 |

OTHER PUBLICATIONS

Korean Office Action issued on Jun. 11, 2023 in Korean Patent Application No. 10-2016-0178547.
International Search Report dated Feb. 26, 2018 from International Patent Application No. PCT/KR2017/012664, 5 pages.
Written Opinion dated Feb. 26, 2018 from International Patent Application No. PCT/KR2017/012664, 8 pages.
U.S. Office Action dated Dec. 4, 2020 for U.S. Appl. No. 16/303,380.
U.S. Office Action dated Apr. 7, 2021 for U.S. Appl. No. 16/303,380.
U.S. Advisory Action dated Jun. 23, 2021 for U.S. Appl. No. 16/303,380.
U.S. Office Action dated Sep. 10, 2021 for U.S. Appl. No. 16/303,380.
U.S. Office Action dated Jan. 25, 2022 for U.S. Appl. No. 16/303,380.
U.S. Advisory Action dated May 9, 2022 for U.S. Appl. No. 16/303,380.
U.S. Office Action dated Aug. 17, 2022 for U.S. Appl. No. 16/303,380.
U.S. Office Action dated Dec. 29, 2022 for U.S. Appl.No. 16/303,380.
U.S. Notice of Allowance dated Mar. 14, 2023 for U.S. Appl. No. 16/303,380.
U.S. Appl. No. 16/303,380, filed Nov. 20, 2018, Hyun Dong Jung, Samsng Electronics Co., Ltd.

* cited by examiner

【Figure 1】
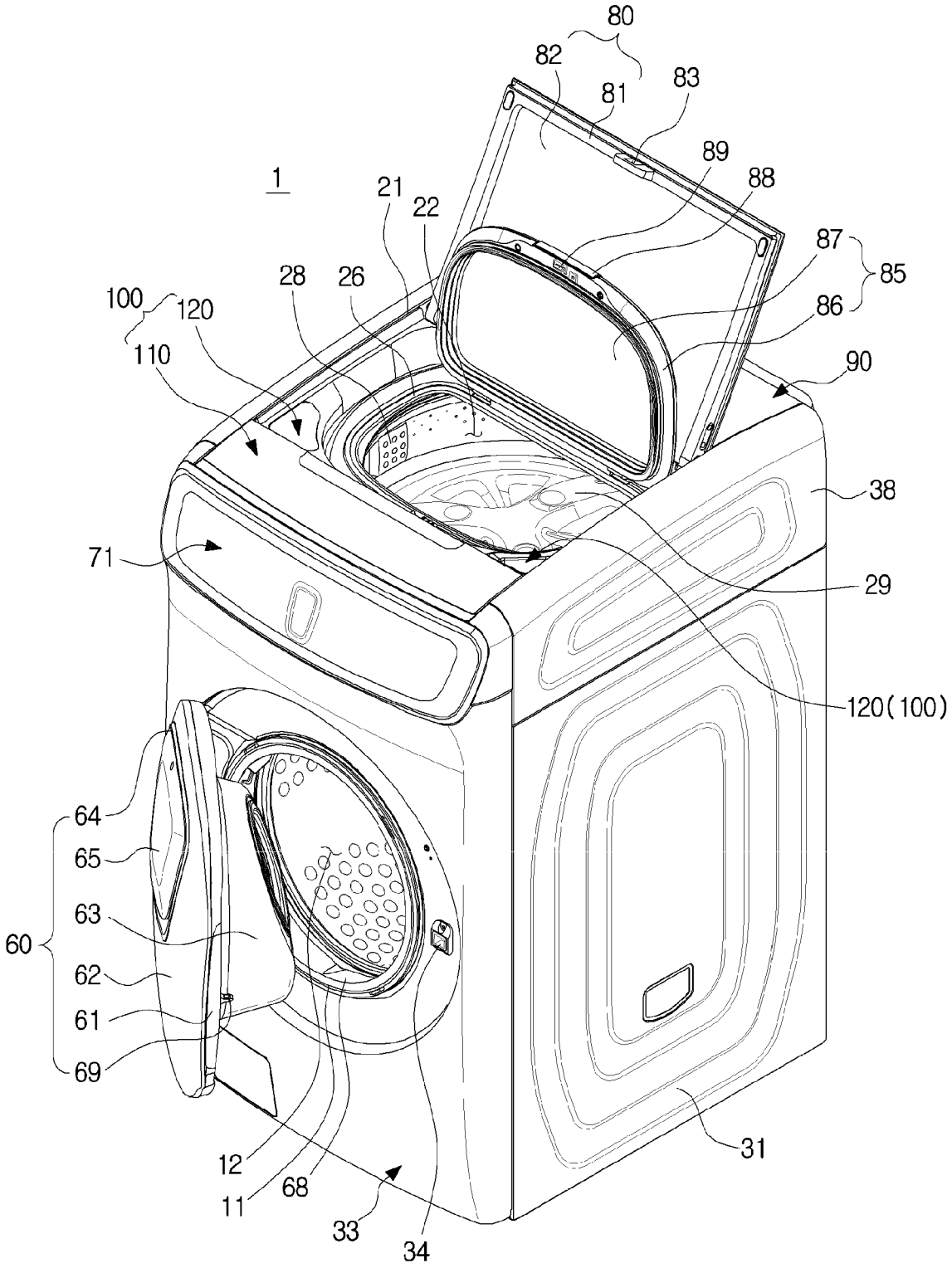

【Figure 2】
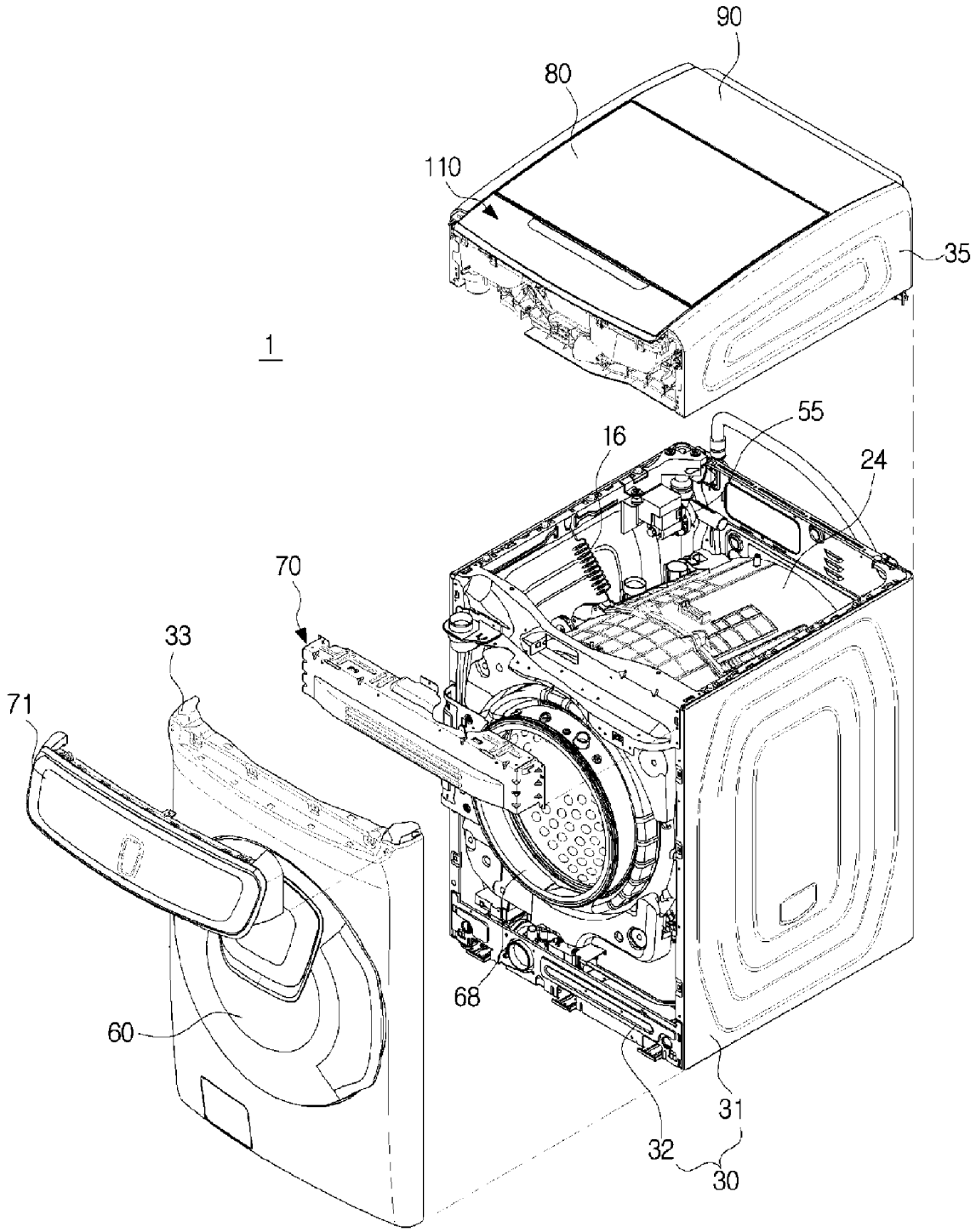

【Figure 3】
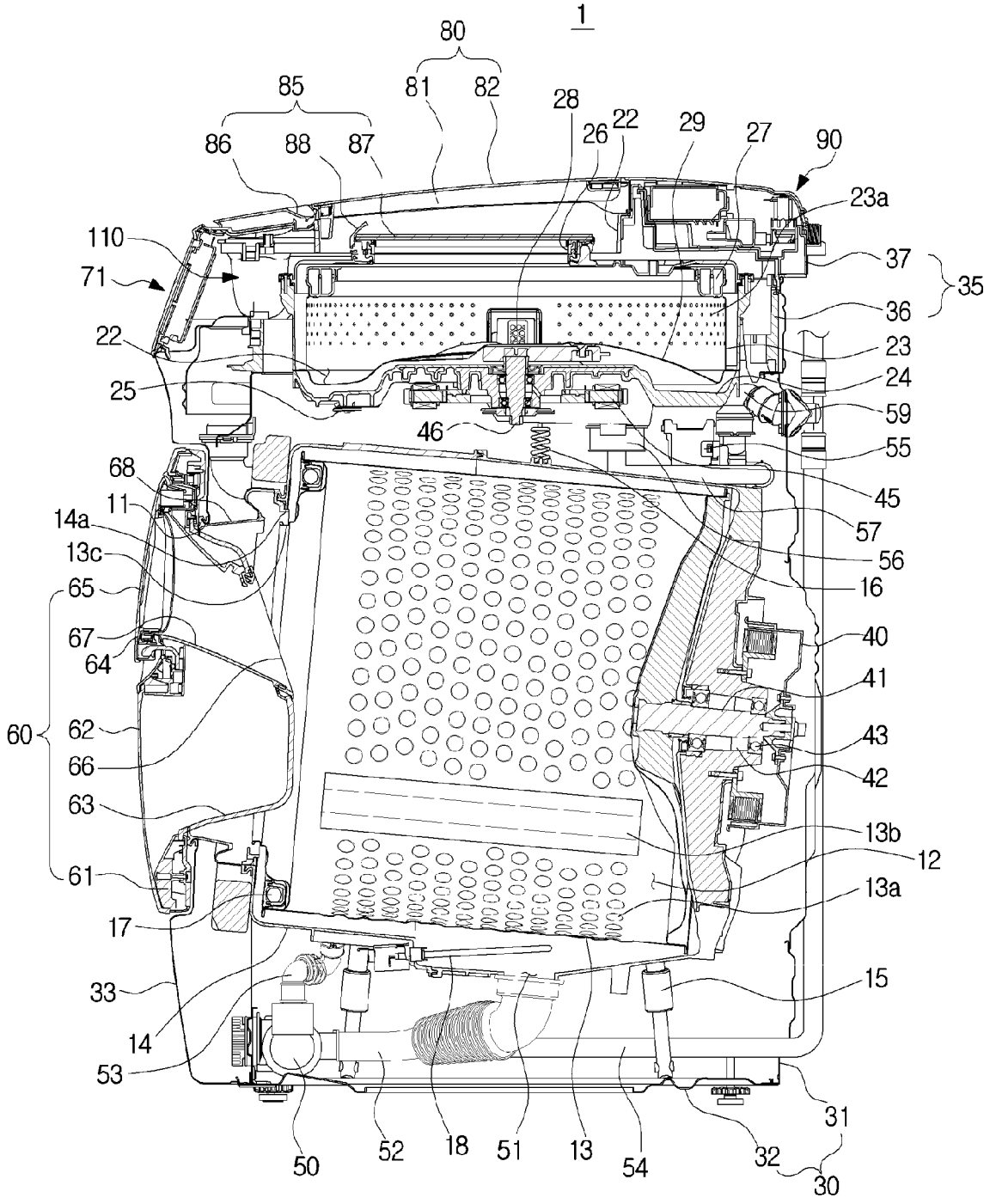

【Figure 4】
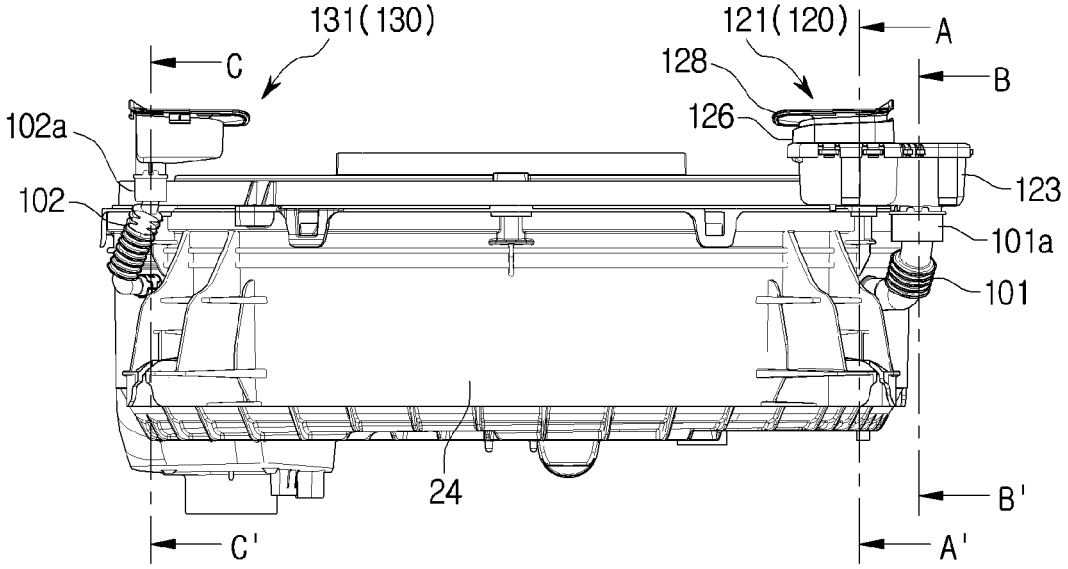

【Figure 5】
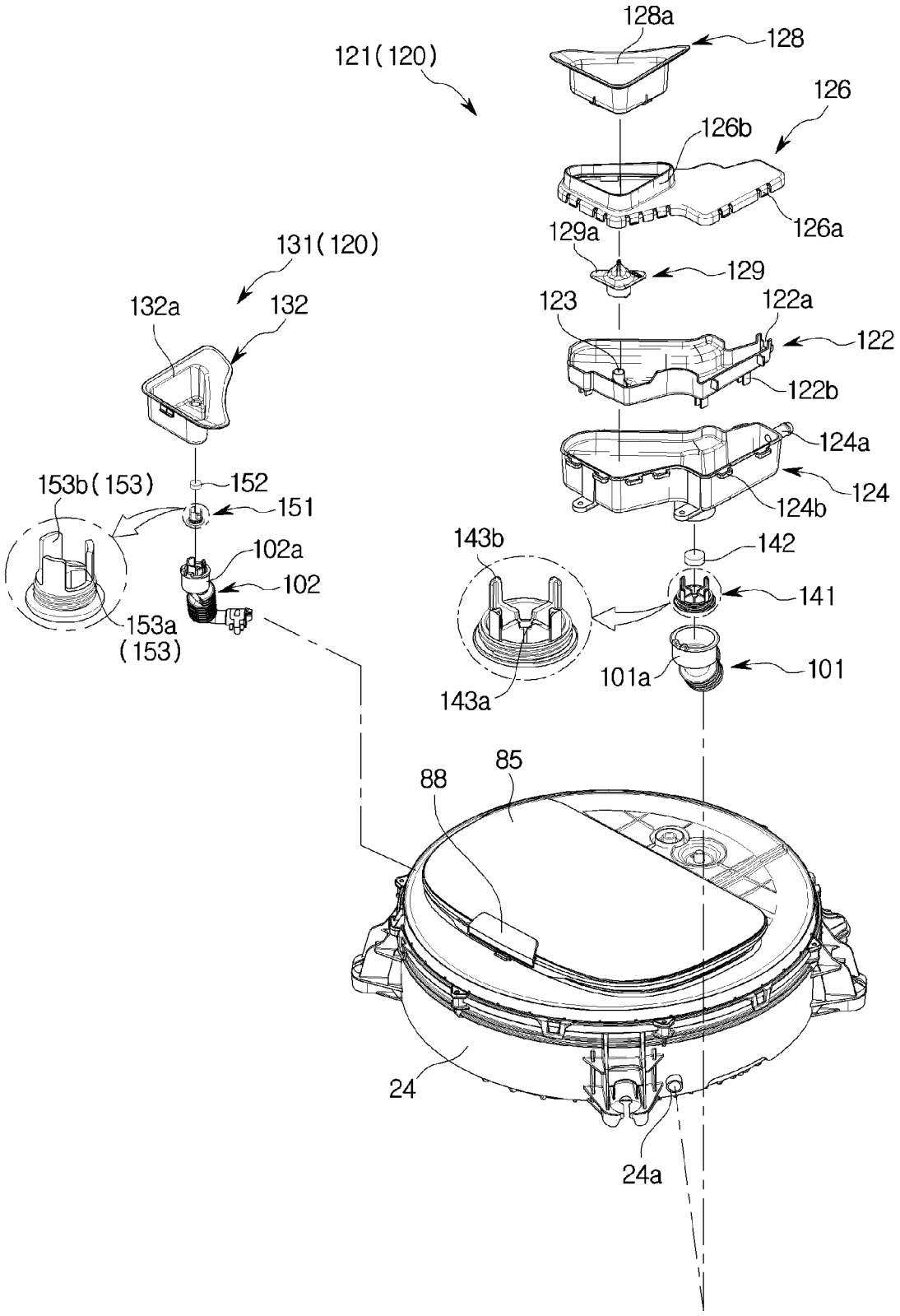

【Figure 6】
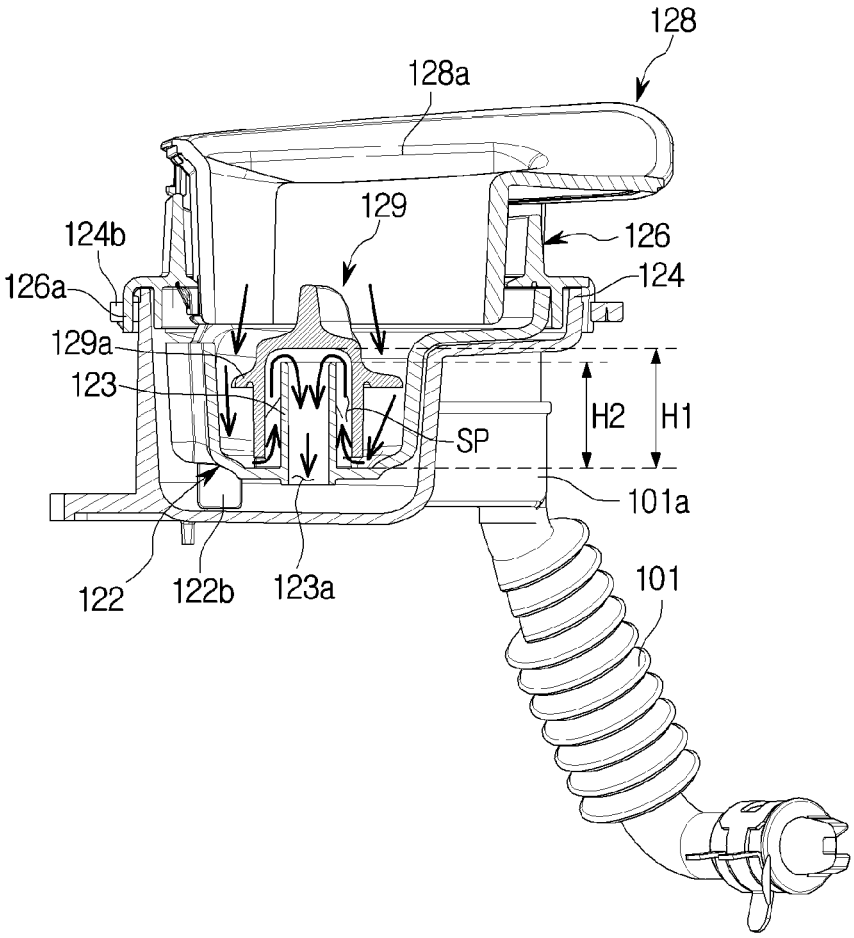

【Figure 7】
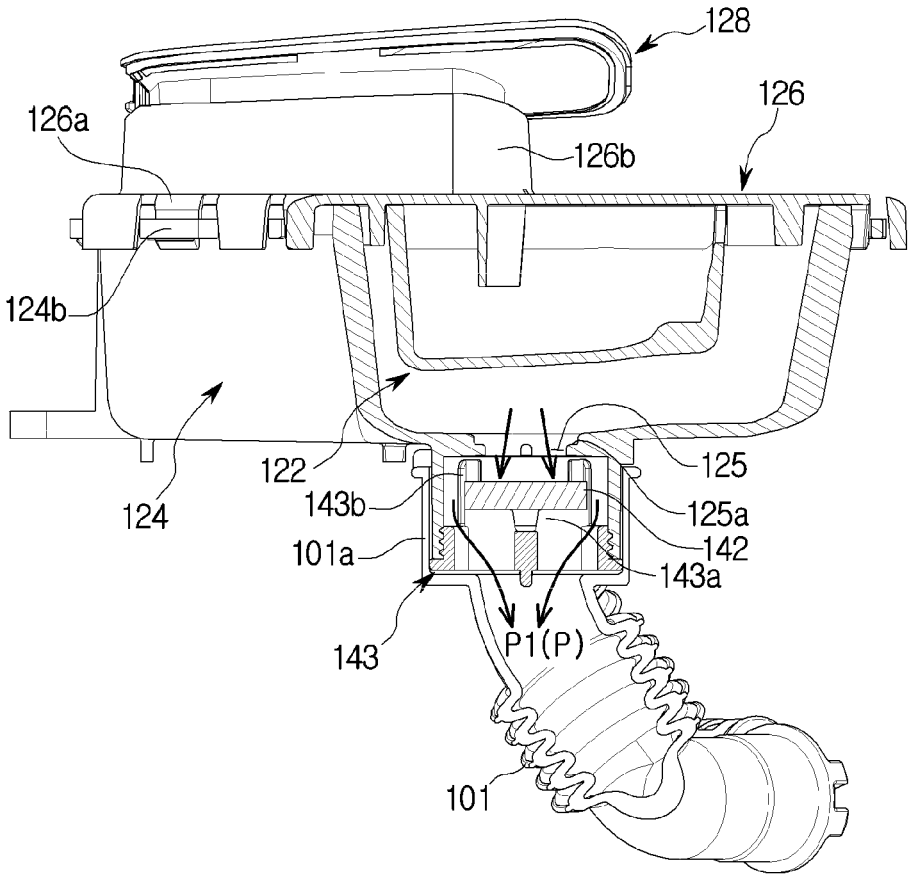

【Figure 8】
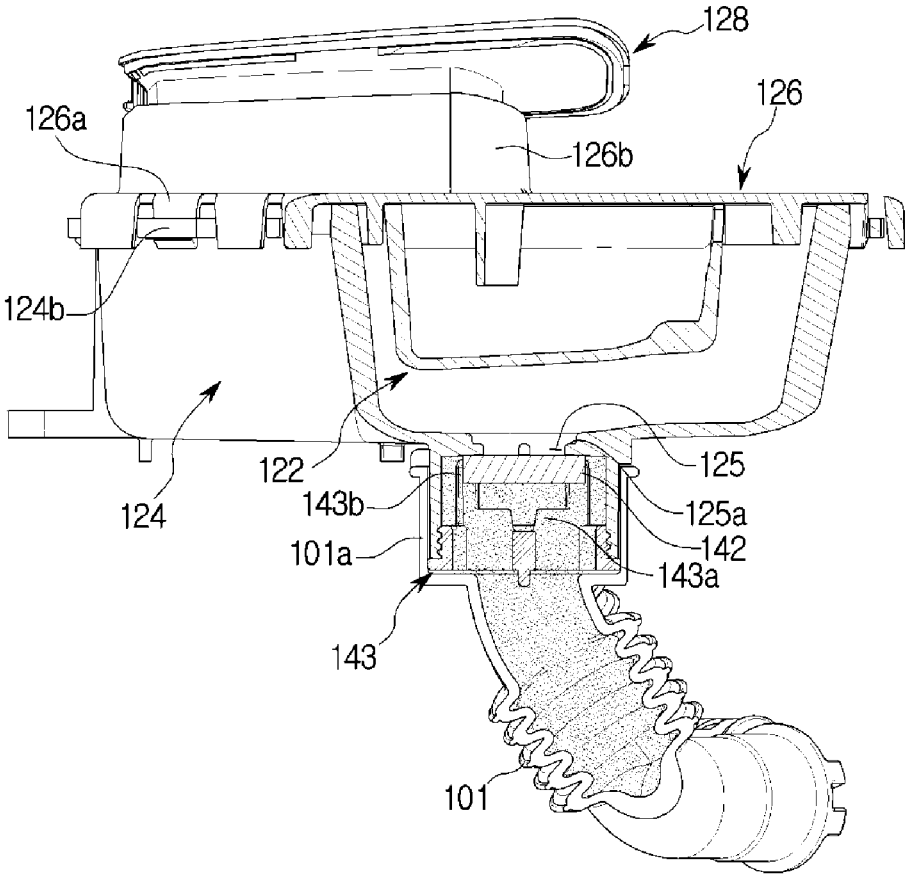

【Figure 9】
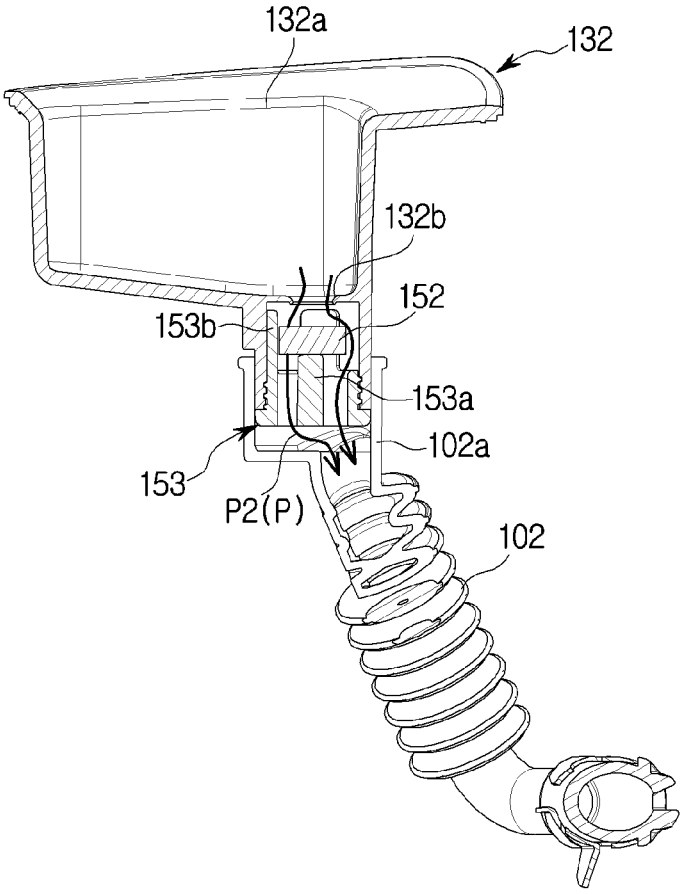

【Figure 10】
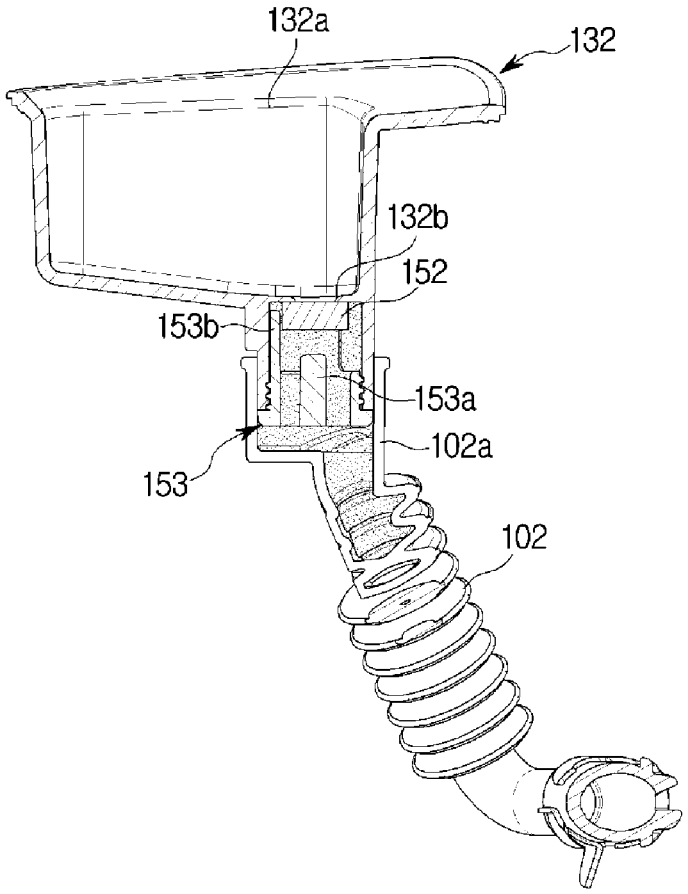

WASHING MACHINE

CROSS-REFERENCE TO RELATED APPLICATIONS

This application is a continuation application of U.S. application Ser. No. 16/303,380, filed Nov. 20, 2018, which is a National Phase Application under 35 U.S.C. § 371 of PCT International Patent Application No. PCT/KR2017/012664, filed Nov. 9, 2017, which claims the foreign priority benefit under 35 U.S.C. § 119 to Korean Patent Application No. 10-2016-0178547 filed Dec. 23, 2016, the contents of which are incorporated herein by reference.

TECHNICAL FIELD

The present disclosure relates to a washing machine, and more particularly, to a washing machine with a plurality of washing devices.

BACKGROUND ART

Washing machines are devices for doing the laundry by rotating its cylindrical drum that contains laundry. As for types of the washing machine, there are washers in which a drum is substantially horizontally positioned to do the laundry by raising and dropping the laundry along the inner wall of the drum while rotating around the horizontal axis, and washers in which a drum having a pulsator therein is substantially vertically positioned to do the laundry using water currents produced by the pulsator while the drum is rotating around the vertical axis.

The washer in which the drum is horizontally positioned is called a front loading washer because a laundry inlet is formed on the front, and the washer in which the drum is vertically positioned is called a top loading washer because a laundry inlet is formed on the top.

Conventional washing machines have a single washing device, so if the user wants to wash separate clothes, the user is bothered to drive the washing machine more than twice. In this case, the user has to drive the washing machine for long hours even if the amount of clothes is relatively small.

DISCLOSURE

Technical Problem

An aspect of the present disclosure is to provide a washing machine with a plurality of washing devices.

Another aspect of the present disclosure is to provide a washing machine capable of preventing the water in a tub from flowing backward into a detergent container.

Another aspect of the present disclosure is to provide a washing machine capable of readily supplying a detergent to a tub.

Technical Solution

In accordance with an aspect of an example embodiment, a washing machine include a first housing; a second housing arranged above the first housing; a first tub covered by the first housing; a second tub covered by the second housing; and a first detergent supplier arranged to supply a detergent to the first tub; a second detergent supplier having a first supply assembly arranged to supply a detergent to the second tub by siphonage when water for laundry is being supplied, wherein the first supply assembly comprises a first valve device arranged in a detergent supply path, in which a detergent is moved to the second tub, for preventing water for laundry from flowing backwards by buoyancy.

The first detergent supplier may be arranged in the second housing.

The first supply assembly may include a first detergent container storing a detergent to be supplied to the second tub; a first detergent container cover communicated to the first detergent container and covering the first detergent container; a siphon tube protruding from the bottom side of the first detergent container and having a cavity formed in the siphon tube; and a siphon cap arranged above the siphon tube and forming a siphon path with the siphon tube.

The siphon cap may include a water-level adjustment lip that protrudes from the outer circumferential surface of the siphon cap.

The water-level adjustment lip may be arranged at a height lower than the height of the siphon tube.

The detergent contained in the first detergent container may be supplied to the second tub when the water-level of the water for laundry supplied to the first detergent container is higher than the height of the siphon tube.

The first valve device may be arranged in the first detergent supply hose connecting the first detergent cover and the second tub.

The first valve device may include a sealing member arranged to be movable in the first detergent supply hose by buoyancy; and a guide member guiding movement of the sealing member.

The first detergent container cover may include a detergent opening communicated to the first detergent supply hose, and wherein the detergent opening comprises a protrusion protruding from the inner side of the detergent opening to support movement of the sealing member in a supply direction of the water for laundry when the water for laundry is flowing backwards.

The sealing member may be formed to include silicon.

The sealing member may be moved to open the detergent supply path when moving in a direction in which the water for laundry is supplied, and may be moved to close the detergent supply path when moving in the opposite direction to the direction in which the water for laundry is supplied.

The guide member may include a first support lip supporting movement of the sealing member in a direction in which the water for laundry is supplied; and a second support lip supporting movement of the sealing member in a vertical direction to the direction in which the water for laundry is supplied.

The second detergent supplier may further include a second supply assembly arranged to provide a detergent to the second tub, wherein the second supply assembly may include a second detergent container storing a detergent to be supplied to the second tub; a second detergent supply hose connecting the second detergent container and the second tub; and a second valve device arranged in the second detergent supply hose and preventing a backflow of water to the second detergent container by buoyancy.

The washing machine may further include a door opening or closing a laundry inlet arranged in the second housing, wherein the second detergent supplier may be arranged to be covered by the door.

The first tub may have a first opening arranged on the front, and wherein the second tub may have a second opening arranged on the top.

In accordance with another aspect of an example embodiment, a washing machine include a first housing; a second housing arranged above the first housing; a first tub covered by the first housing; a second tub covered by the second housing; and a first detergent supplier arranged to supply a detergent to the first tub; a second detergent supplier having a first detergent container storing a detergent to be supplied to the second tub and arranged to supply a detergent to the second tub, wherein the second detergent supplier includes a valve device arranged in a detergent supply path, in which a detergent is moved to the second tub, and provided to prevent reverse flow to the first detergent container by buoyancy.

The first detergent supplier may be disposed in front of the second detergent supplier.

The second detergent supplier may be provided to supply detergent from the detergent container to the second tub when the washing water supplied into the first detergent container exceeds a predetermined level.

In accordance with still another aspect of an example embodiment, a washing machine include a first housing; a second housing arranged above the first housing; a first tub covered by the first housing; a second tub covered by the second housing; and a first detergent supplier arranged to supply a detergent to the first tub and disposed in the second housing; a second detergent supplier configured to supply detergent to the second tub, disposed in the second housing, and having a valve device provided to prevent reverse flow of washing water by buoyancy.

The valve device may be configured to include a material movable by buoyancy of the washing water.

Advantageous Effects

According to embodiments of the present disclosure, a washing machine may have a plurality of washing devices, enabling clothes to be washed separately as needed.

According to embodiments of the present disclosure, a washing machine may have a buoyancy valve in a detergent supply path to open or close the detergent supply path by means of buoyancy, thereby preventing the water in the tub from flowing backward into the detergent container.

According to embodiments of the present disclosure, a washing machine may have a detergent supplier to supply a detergent to the tub when water is being supplied by siphonage, thereby readily supplying the detergent to the tub.

DESCRIPTION OF DRAWINGS

FIG. 1 is a perspective view of a washing machine, according to an embodiment of the present disclosure;

FIG. 2 shows the washing machine shown in FIG. 1 with some parts separated therefrom;

FIG. 3 is a cross-sectional view of the washing machine shown in FIG. 1;

FIG. 4 shows a second tub and a second detergent supplier of the washing machine shown in FIG. 1;

FIG. 5 is an exploded view of the second tub and the second detergent supplier shown in FIG. 4;

FIG. 6 is a cross-sectional view along line A-A' marked in FIG. 4;

FIG. 7 is a cross-sectional view along line B-B' marked in FIG. 4;

FIG. 8 shows a first sealing member, which is shown in FIG. 7, lifted by buoyancy;

FIG. 9 is a cross-sectional view along line C-C' marked in FIG. 4; and

FIG. 10 shows a second sealing member, which is shown in FIG. 9, lifted by buoyancy.

MODES OF THE INVENTION

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms.

The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

Reference will now be made in detail to embodiments, examples of which are illustrated in the accompanying drawings, wherein like reference numerals refer to the like elements throughout.

FIG. 1 is a perspective view of a washing machine 1, according to an embodiment of the present disclosure. FIG. 2 shows the washing machine 1 shown in FIG. 1 with some parts separated therefrom. FIG. 3 is a cross-sectional view of the washing machine 1 shown in FIG. 1.

Referring to FIGS. 1 to 2, the washing machine 1 may include a first washing device of a front-loading type with a first laundry inlet 11 formed on the front, and a second washing device of a top-loading type with a second laundry inlet 21 formed on the top.

The washing machine 1 may include a first drum 13 in which a first washing space 12 is formed and a first tub 14 containing the first drum 13 and storing water for washing or rinsing to be used in a washing course or a rinsing course. The first drum 13 and the first tub 14 may be shaped like a cylinder with at least a portion of a plane opened, and the open portion may be positioned almost toward the front. The first tub 14 may include a first opening **14*a*** formed almost toward the front.

The washing machine 1 may include a first housing 30 covering the first drum 13 and the first tub 14. Specifically, the first housing 30 may include a side frame 31 forming the side and rear exterior, and a bottom frame 32 forming the bottom plane.

Furthermore, the washing machine 1 may include a damper 15 and a spring 16 to support the first tub 14 against the first housing 30. The damper 15 may support the first tub 14 from below by connecting the outer side of the first tub 14 and the bottom frame 32, and the spring 16 may support the first tub 14 from above by connecting the outer side of the first tub 14 and the top end of the side frame 31. The damper 15 and the spring 16 may relieve vibration, noise, and shock caused by a motion of the first tub 14.

Where to install the damper 15 and the spring 16 is not limited to the top end of the side frame 31 and the bottom frame 32, but may be anywhere to support the first tub 14 by connecting a side of the first tub 14 and a portion of the first housing 30 as needed.

The washing machine 1 may include a first driving motor 40 arranged behind the first tub 14 to rotate the first drum 13. A first driving shaft 41 may be coupled to the back of the first drum 13 for delivering power from the first driving motor 40.

A lot of first through holes 13*a* may be formed in the circumference of the first drum 13 for water circulation. On the inside circumference of the first drum 13, a plurality of lifters 13*b* may be provided to enable the laundry to be raised and fallen while the first drum 13 is rotating. A first balancer 17 may be equipped on a front portion of the first drum 13 to help the first drum 13 stably spin at high speed.

The first driving shaft 41 may be arranged between the first drum 13 and the first driving motor 40. One end of the first driving shaft 41 may be coupled to the back plate of the first drum 13, and the other end of the first driving shaft 41 may extend to the outside of the back wall of the first tub 14. When the first driving motor 40 drives the first driving shaft 41, the first drum 13 coupled to the first driving shaft 41 rotates around the first driving shaft 41.

On the back wall of the first tub 14, a bearing housing 42 may be provided to rotationally support the first driving shaft 41. The bearing housing 42 may be made of an aluminum alloy and may be inserted to the back wall of the first tub 14 during injection molding of the first tub 14. Bearings 43 may be provided between the bearing housing 42 and the first driving shaft 41 to enable smooth rotation of the first driving shaft 41.

The washing machine 1 may include a function of doing laundry with hot water. To obtain hot water, a heater 18 may be arranged on the bottom of the first tub 14 to heat the water for washing or rinsing stored in the first tub 14.

The washing machine 1 may include a first drain pump 50 arranged under the first tub 14 for draining the water out of the washing machine 1 from inside the first tub 14, a first coupling hose 52 connecting a first drain 51 of the first tub 14 and the first drain pump 50 for allowing the water inside the first tub 14 to flow into the first drain pump 50, a circulation hose 53 connecting the first drain pump 50 and the first tub 14 for circulating the water flowing into the first drain pump 50 to the first tub 14, and a first drain hose 54 for guiding the water pumped by the first drain pump 50 to a connector-110.

The washing machine 1 may include a front cover 33 with the first laundry inlet 11 through which clothes may be thrown into the first washing space 12. A first door 60 may be combined with the front cover 33 for opening or shutting the first laundry inlet 11.

The first door 60 may be arranged to correspond to the first laundry inlet 11 and to be able to pivot on the front cover 33. The first door 60 may include a first door frame 61, a first door cover 62, and a door glass 63.

Although the first door frame 61 is shown to be shaped almost like a round ring in the embodiment of the present disclosure, it may be implemented as being shaped almost like a square ring. The first door cover 62 and the door glass 63 may be implemented to include a transparent material allowing the inside of the first drum 13 to be seen from outside of the washing machine 1 while the first door 60 holds the first laundry inlet 11 shut. The door glass 63 may be formed to be swollen from the first door frame 61 toward the inside of the first drum 13. With this structure, the door glass 63 may be inserted to the inside of the first laundry inlet 11 when the first door 60 is shut.

The first door 60 may include a first hinge coupler formed on one side of the first door frame 61 to be able to pivot on the front cover 33, and the first hinge coupler may be coupled to a first hinge arranged adjacent to the first laundry inlet 11. On the other side of the first door frame 61, a first hook 69 may be provided. A first hook receiver 34 may be provided on the front cover 33 to match the first hook 69, enabling the first door 60 to hold the first laundry inlet 11 shut.

The first door 60 may include an auxiliary laundry inlet 64 and an auxiliary door 65 to open or shut the auxiliary laundry inlet 64 in order to throw clothes into the first washing space 12 while the first door 60 is shut. The auxiliary door 65 may be pivotally mounted on the first door cover 62.

To throw the laundry into the washing machine 1 through the auxiliary laundry inlet 64 of the first door 60, the laundry needs to pass through the door glass 63. For this, the door glass 63 may have a glass through hole 66 therein. Alternatively, the door glass 63 may be formed to have the top portion sunken to prevent the door glass 63 from being placed behind the auxiliary laundry inlet 64.

To connect the auxiliary laundry inlet 64 of the first door 60 and the glass through hole 66 of the door glass 63, the first door 60 may include a coupling guide 67. The coupling guide 67 may be formed in the shape of a tube with both ends open and a cavity therein.

Specifically, the coupling guide 67 may be connected to the auxiliary laundry inlet 64 at one end and to the glass through hole 66 at the other end. In the embodiment, the coupling guide 67 may be arranged to incline downward from front to back. In other words, the one end of the coupling guide 67 connected to the auxiliary laundry inlet 64 may be at a higher level than the other end. With this configuration, the user may be able to easily throw the laundry into the first drum 13 through the auxiliary laundry inlet 64.

Although the auxiliary door 65 is arranged on the first door 60 in this embodiment, it is not limited thereto and the first door 60 may be provided without the auxiliary laundry inlet 64, the auxiliary door 65, and the coupling guide 67.

The washing machine 1 may include a diaphragm 68 arranged between the first laundry inlet 11 of the front cover 33 and the first opening 14*a* of the first tub 14.

The diaphragm 68 may create a passage from the first laundry inlet 11 to a third opening 13*c* of the first drum 13, to reduce vibration transferred to the front cover 33 while the first drum 13 is rotating. A portion of the diaphragm 68 may be located between the first door 60 and the front cover 33 to prevent the water in the first tub 14 from leaking out of the washing machine 1.

The washing machine 1 may include a second drum 23 in which a second washing space 22 is formed and a second tub 24 containing the second drum 23 and storing water for washing or rinsing to be used in a washing course or a rinsing course. The second drum 23 and the second tub 24 may be shaped like a cylinder with at least a portion of a plane open, and the open portion may be positioned almost toward he top. The second tub 24 may include a second opening 26 formed toward almost the top.

The washing machine 1 may include a second housing 35 to cover the second drum 23 and the second tub 24. Specifically, the second housing 35 may include a lower frame 36 to support the second tub 24 and an upper frame 37 equipped with the second laundry inlet 21, through which clothes may be thrown in, and settled in an upper portion of the lower frame 36.

A side cover 38 may cover the left and right sides of the lower frame 36 and the upper frame 37 with a single member, thereby simplifying the sides of the second housing 35 and preventing random falling of the lower frame 36 and the upper frame 37 when they are dismounted from vibration or something and thus from hurting the user.

The washing machine 1 may include a second door 80 equipped in the second housing 35 for opening or shutting the second laundry inlet 21. The second door 80 may be arranged to correspond to the second laundry inlet 21 and to be able to pivot on the upper frame 37.

The second door 80 may include a second door frame 81 and a second door cover 82. The second door cover 82 may be implemented to include a transparent material allowing the inside of the second tub 24 and the second drum 23 to be seen from outside of the washing machine 1 while the second door 80 shuts the second laundry inlet 21.

Second hinges (not shown) may be provided on the left and right sides of the second door frame 81 for the second door 80 to be able to pivot on the upper frame 37. The second hinge may be coupled to a second hinge coupler (not shown) arranged around the second laundry inlet 21. A latch container 83 may be provided on the front of the second door frame 81, and a latch may be provided on the upper frame 82 to match the latch container 83 of the second door frame 81. With this configuration, the second door 80 of the washing machine 1 in accordance with the embodiment of the present disclosure may hold the second laundry inlet 21 shut.

The second drum 23 may have a cylindrical form with the top open and may be arranged to be able to rotate within the second tub 23. A lot of second through holes 23*a* may be formed in the side and/or bottom plane of the second drum 23 for water circulation. A second balancer 27 may be equipped in an upper portion of the second drum 23 to help the second drum 23 stably spin at high speed. A filter 28 may be attached onto an inner side of the second drum 23 to filter out some foreign materials coming out during washing.

There may be a curved portion 29 formed on the bottom of the second drum 23 for creating water currents. Although not shown, the washing machine 1 may further include a pulsator arranged inside the second drum 23 to produce water currents.

The second tub 24 may have a cylindrical form and may be supported by the lower frame 36 according to a suspension 25. Specifically, the second tub 24 may be supported in a form of hanging to the lower frame 36 by four of the suspensions 25. The second opening 26 may be formed on the top of the second tub 23 to correspond to the second laundry inlet 21, and may be coupled with a third door 85 to open or shut the second opening 26. The third door 85 may seal the second washing space 22 to prevent leakage of wet steam if the second washing unit performs a washing course with hot water.

The third door 85 may include a third door frame 86 and a third door cover 87. The third door cover 87 may be implemented to include a transparent material allowing the inside of the second drum 23 to be seen from outside of the second tub 24 while the third door 85 shuts the second opening 26.

A third hinge (not shown) may be arranged around the second opening 26 for the third door 85 to be able to pivot on the second tub 24, and may be coupled with a third hinge coupler (not shown) arranged on a side of the third door frame 86. A handle 88 may be provided on the other side of the third door frame 86 to open the third door 85 and may be equipped with a second hook 89. A second hook container (not shown) may be arranged on the second tub 24 to match the second hook 89, enabling the third door 85 to hold the second opening 26 shut. Furthermore, when the handle 88 is pulled, the second hook 89 falls out of the second hook container, enabling the third door 85 to fully open the second washing space 22.

The washing machine 1 may include a second driving motor 45 arranged under the second tub 24 to rotate the second drum 23. A second driving shaft 46 may be coupled to the bottom of the second drum 23 for delivering power from the second driving motor 45. One end of the second driving shaft 46 may be coupled to the bottom plate of the second drum 23, and the other end of the second driving shaft 46 may extend to the outside of the bottom wall of the second tub 24. When the second driving motor 45 drives the second driving shaft 46, the second drum 23 coupled to the second driving shaft 46 rotates around the second driving shaft 46.

Although not shown, if the pulsator is arranged on the bottom of the second drum 23, the washing machine 1 may further include a power switching unit to deliver the driving force produced by the second driving motor 45 to the second drum 23 and the pulsator simultaneously or selectively.

The washing machine 1 may include a second drain pump 55 arranged under the second tub 24 for draining the water stored in the second tub 24 to the outside of the washing machine 1, and a second drain hose 59 for guiding the water pumped by the second drain pump 55 to the outside of the washing machine 1. The second drain pump 55 may be installed above the first housing 30.

A second drain 56 may be arranged on the bottom of the second tub 24 for draining the water from the second tub 24, and the second drain 56 and the second drain pump 55 may be connected by a second coupling hose 57, allowing the water from the second tub 24 to flow into the second drain pump 55.

The washing machine 1 may include a water supplier 90 for supplying laundry water to the first and second tubs 14 and 24. The water supplier 90 may be arranged in the second housing 35. Specifically, the water supplier 90 may be arranged on the upper frame 37 and preferably, behind the second laundry inlet 21.

The washing machine 1 may include a detergent supplier 100 for supplying a detergent to each of the first and second tubs 14 and 24. The detergent supplier 100 may include a first detergent supplier 110 for supplying a detergent to the first tub 14 and a second detergent supplier 120 for supplying a detergent to the second tub 24.

The first detergent supplier 110 may be arranged in the second housing 35. Specifically, the first detergent supplier 91 may be arranged on the upper frame 37 and preferably, ahead of the second laundry inlet 21. The first detergent supplier 110 may be arranged in front of the second detergent supplier 120, which will be described later. The second detergent supplier 120 may be arranged on top of the first tub 14.

The second detergent supplier 120 may be arranged in the second housing 35, and may contain a fabric softener and/or a bleaching agent to be supplied into the second tub 24. The second detergent supplier 120 may be arranged on an upper frame 37. The second detergent supplier 120 may be arranged on each of the left and right ends of the front side of the second opening 26. The second detergent supplier 120 may be arranged for the user to access it as the second door 80 is opened. The second detergent supplier 120 may be covered by the second door 80. The second detergent supplier 120 will be described in detail later.

The washing machine 1 may include a fixing bracket 70 to securely combine the first and second housings 30 and 35.

The washing machine 1 may include a control panel 71 arranged above the front cover 33 for controlling the washing machine 1. The control panel 71 may include an input (not shown) for receiving operation commands for the washing machine 1 from the user, and a display (not shown) for displaying operation information of the washing machine 1.

FIG. 4 shows the second tub 24 and the second detergent supplier 120 of the washing machine 1 shown in FIG. 1. FIG. 5 is an exploded view of the second tub 24 and the second detergent supplier 120 shown in FIG. 4. FIG. 6 is a cross-sectional view along line A-A' marked in FIG. 4. FIG. 7 is a cross-sectional view along line B-B' marked in FIG. 4. FIG. 8 shows a first sealing member 122, which is shown in FIG. 7, lifted by buoyancy.

Referring to FIGS. 4 and 5, the second detergent supplier 120 may include a first supply assembly 121 arranged to supply a detergent to the second tub 24 by siphonage when water for laundry is being supplied, and a second supply assembly 131 arranged to supply a detergent, which is thrown in, right into the second tub 24. The detergent as herein used may include a laundry detergent, a fabric softener, and a bleaching agent.

A path for the detergent to move to the second tub 24 is defined as a detergent supply path P. The detergent supply path P may include a first detergent supply path P1 in which the detergent supplied through the first supply assembly 121 moves, and a second detergent supply path P2 in which the detergent supplied through the second supply assembly 131 moves.

Referring to FIGS. 5 to 8, the first supply assembly 121 may be arranged at an end of the front side of the second opening 26 of the second tub 24. The first supply assembly 121 may be placed at the right end of the front side of the top of the second tub 24. The first supply assembly 121 may supply a fabric softener to the second tub 24. The first supply assembly 121 may include a first detergent container 122, a first detergent container cover 124, a first detergent container lead 126, a first detergent guide 128, a siphon cap 129, a first detergent supply hose 101, and a first valve device 141.

The first detergent container 122 may contain a detergent to be supplied to the second tub 24. The first detergent container 122 may be located in the internal space formed by the first detergent container cover 124 and the first detergent container lead 126, which will be described later. The first detergent container 122 may include a support member **122*b* extending toward the first detergent container cover 124 to be placed a certain distance away from the first detergent cover 124**.

The first detergent container 122 may include a siphon tube 123 with a cavity **123*a* formed therein, which protrudes upward from the bottom side of the first detergent container 122. The siphon tube 123 may be formed to have a first height H1. The first detergent container 122 may include an inlet 122*a* through which water for laundry is supplied from the water supplier 90**.

The first detergent container cover 124 may be arranged under the first detergent container 122 to cover a lower portion of the first detergent container 122.

The first detergent container cover 124 may be linked to the first detergent container 122. The first detergent container cover 124 may guide the water for laundry supplied to the first detergent container 122 and the detergent flowing in through the siphon tube 123 to the first detergent supply hose 101.

The first detergent container cover 124 may include an inflow tube **124*a* connected to the water supplier 90. The first detergent container cover 124 may include a first detergent opening 125 formed on the bottom side to be linked to the first detergent supply hose 101. The first detergent opening 125 may include a protrusion 125*a* that protrudes from the inner side of the first detergent opening 125 to support movement of the first sealing member 142 in a direction to which water is supplied when the water is moving backwards. The protrusion 125 may support the top of the first sealing member 142, thereby preventing bending of the first sealing member 142 and preventing the first sealing member 142 from passing through the first detergent opening 125 and moving into the first detergent container cover 124**.

To be combined with the first detergent lead 126, which will be described later, the first detergent container cover 124 may include a first fastener **124*b* to be coupled with a second fastener 126*a* of the first detergent container lead 126**.

The first detergent container lead 126 may cover an upper portion of the first detergent container cover 124, and include the second fastener **126*a* to be coupled with the first fastener 124*b* of the first detergent container cover 124. The first detergent container lead 126 may include an insertion hole 126*b* to which the first detergent guide 128**, which will be described later, is inserted.

The first detergent guide 128 includes a first detergent inlet **128*a* formed for the user to throw in a detergent through it. A portion of the first detergent guide 128 may be inserted and fixed to the insertion hole 126*b* of the first detergent container lead 126. The first detergent guide 128 may guide the detergent thrown in by the user to the first detergent container 122**.

The siphon cap 129 may be placed above the siphon tube 123, forming a siphon path SP with the siphon tube 123. The siphon cap 129 may include a cavity formed therein.

The siphon cap 129 may include a water-level adjustment lip **129*a* that almost horizontally protrudes from the outer circumferential surface of the siphon cap 129. The water-level adjustment lip 129*a* may be arranged at a height H2 lower than the height H1 of the siphon tube 123. The user may throw a detergent into the first detergent container 122 as high as the height of the water-level adjustment lip 129*a*. When the detergent fills the first detergent container 122 as high as the height of the water-level adjustment lip 129*a*, the detergent fills only a portion of the siphon path SP, no siphonage occurs and thus, the detergent is not moved to the first detergent container cover 1234. However, if the level of the water for laundry and/or the detergent becomes higher than the height H1 of the siphon tube 123 as the water for laundry is supplied to the first detergent container, all the water for laundry and/or the detergent contained in the first detergent container 122 may be supplied to the second tub 24** by siphonage.

With this configuration, the washing machine 1 in accordance with the embodiment of the present disclosure eliminates the need for the user to open the second washing space 22 and separately throw in a detergent thereto because the detergent is automatically supplied to the second tub 24 as the water for laundry is supplied to the second supply assembly 121.

The first detergent supply hose 101 may be connected to a first connection port 24*a* of the second tub 24 at one end and connected to the first detergent opening 125 of the first detergent container cover 124 at the other end 101*a*. At least a portion of the first detergent supply hose 101 may be formed as a flexible hose to prevent vibrations of the second tub 24 from being transferred to the first supply assembly 121.

The first valve device 141 may be arranged in the first detergent supply hose 101 connecting the first detergent container cover 124 and the second tub 24. Specifically, the first valve device 141 may be arranged inside the other end 101*a* of the first detergent supply hose 101. The first valve device 141 may be arranged in the detergent supply path P along which the detergent is moved to the second tub 24, to prevent a backflow of the water for laundry by buoyancy of the water.

The first valve device 141 may include the first sealing member 142 provided to be movable in the first detergent supply hose 101 by buoyancy and a first guide member 143 for guiding the movement of the first sealing member 142.

The first sealing member 142 may be made by including a material that has a property of being movable in the first detergent supply hose 101 by buoyancy of the water for laundry. The first sealing member 142 may be made by including silicon.

The first sealing member 142 may be moved to open the first detergent supply path P1 when the water for laundry is moved in a supplying direction, and moved to close the first detergent supply path P1 when the water for laundry is moved in the opposite direction to the supplying direction. Specifically, the first sealing member 142 may be moved downwards by pressure of the water for laundry and gravity when the water for laundry is supplied, and may close the first detergent opening 125 by moving upwards by buoyancy of the water for laundry when the water for laundry is flowing backwards.

The first guide member 143 may include a first support lip 143*a* for supporting movement of the first sealing member 142 in the water supply direction, and a second support lip 143*b* for supporting movement of the first sealing member 142 in an almost vertical direction to the water supply direction.

Specifically, the first support lip 143*a* may limit a movement range of the first sealing member 132 when the first sealing member 142 is moving in the water supply direction. That is, the first support lip 143*a* may support the bottom end of the first sealing member 142.

The second support lip 143*b* may limit a movement of the first sealing member 142 in a lateral direction. That is, the second support lip 143*b* may support the side surface of the first sealing member 142. Accordingly, the first sealing member 142 may be moved only in the almost vertical direction along a direction in which the water for laundry flows.

With this configuration, the washing machine 1 in accordance with the embodiment of the present disclosure may prevent water for laundry from moving backwards from the second tub 24 to the first detergent container cover 124. That is, since the height of the second tub 24 is relatively low, the water contained therein for laundry may rise up along the inner circumferential face of the second tub 24 by the centrifugal force when the second drum 23 is rotating. Accordingly, the water may flow backwards into the first detergent container cover 124 along the first detergent supply hose 101, but such a backflow of the water may be prevented because the first sealing member 142 is lifted by buoyancy of the water to block the first detergent opening 125 when the water is flowing backwards.

FIG. 9 is a cross-sectional view along line C-C' marked in FIG. 4.

FIG. 10 shows a second sealing member 132, which is shown in FIG. 9, lifted by buoyancy.

Referring to FIGS. 5, 9, and 10, the second detergent supplier 120 may further include the second supply assembly 131. The second supply assembly 131 may be placed at an end of the front side of the second opening 26 of the second tub 24. The second supply assembly 131 may be placed at the left end of the front side of the top of the second tub 24. The second supply assembly 131 may supply a bleaching agent to the second tub 24. The second supply assembly 131 may include a second detergent container 132, a second detergent supply hose 102, and a second valve device 151.

The second detergent container 132 may contain a detergent to be supplied to the second tub 24. Unlike the first supply assembly 121, the second detergent container 132 may be arranged to supply a detergent into the second tub 24 right after the detergent is thrown in thereto. That is, the second detergent container 132 has no extra inflow port through which the water for laundry flows in.

The second detergent container 132 may include a second detergent inlet 132*a* formed for the user to throw in a detergent through it. The second detergent inlet 132*a* may guide the detergent thrown in by the user to the second detergent container 132.

The second detergent supply hose 102 may be connected to the second tub 24 at one end and connected to the second detergent container 132 at the other end 102*a*. At least a portion of the second detergent supply hose 102 may be formed as a flexible hose to prevent vibrations of the second tub 24 from being transferred to the second supply assembly 131.

The second valve device 151 may be arranged in the second detergent supply hose 102 connecting the second detergent container 132 and the second tub 24. Specifically, the second valve device 151 may be arranged inside the other end 102*a* of the second detergent supply hose 102. The second valve device 151 may be arranged in the detergent supply path P along which the detergent is moved to the second tub 24, to prevent a backflow of the water for laundry by buoyancy of the water.

The second valve device 151 may include the second sealing member 152 provided to be movable in the second detergent supply hose 102 by buoyancy and a second guide member 153 for guiding the movement of the second sealing member 152.

The second sealing member 152 may be made by including a material that has a property of being movable in the first detergent supply hose 102 by buoyancy of the water for laundry. The second sealing member 152 may be made by including silicon.

The second sealing member 152 may be moved to open the second detergent supply path P2 when the water for laundry is moved in a supplying direction, and moved to close the second detergent supply path P2 when the water for laundry is moved in the opposite direction to the supplying direction. Specifically, the second sealing member 152 may be moved downwards by pressure of the water for laundry and gravity when the water for laundry is supplied, and may close the second detergent opening 132*b* by moving upwards by buoyancy of the water for laundry when the water for laundry is flowing backwards.

The second guide member 153 may include a third support lip 153*a* for supporting movement of the second sealing member 153 in the water supply direction, and a fourth support lip 153*b* for supporting movement of the second sealing member 152 in an almost vertical direction to the water supply direction.

Specifically, the third support lip 153*a* may limit a movement range of the second sealing member 152 when the second sealing member 152 is moving in the water supply direction. That is, the third support lip 153*a* may support the bottom end of the second sealing member 152.

The fourth support lip 153*b* may limit a movement of the second sealing member 152 in a lateral direction. That is, the fourth support lip 153*b* may support the side surface of the second sealing member 152. Accordingly, the second sealing member 152 may be moved only in the almost vertical direction along a direction in which the water for laundry flows.

With this configuration, the washing machine 1 in accordance with the embodiment of the present disclosure may prevent water for laundry from moving backwards from the second tub 24 to the second detergent container 132. That is, since the height of the second tub 24 is relatively low, the water contained therein for laundry may rise up along the inner circumferential face of the second tub 24 by the centrifugal force when the second drum 23 is rotating. Accordingly, the water may flow backwards into the second detergent container 132 along the second detergent supply hose 102, but such a backflow of the water may be prevented because the second sealing member 152 is lifted by buoyancy of the water to block the second detergent opening 132*b* when the water is flowing backwards.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The invention claimed is:

1. A washing machine comprising:
a tub having an open top surface;
a housing covering the tub; and
a detergent supplier forming a detergent supply path along which water and a detergent are suppliable to the tub, and including:
a detergent container configured to store detergent,
a buoyancy-type sealing member in the detergent supply path,
a detergent container cover covering at least a portion of the detergent container and including:
a detergent opening formed on a bottom side of the detergent container cover and through which the detergent supply path extends, and
a protrusion protruding from an inner side of the detergent opening and configured to support the buoyancy-type sealing member,
wherein the detergent container cover is configured so that:
with water being back-flowed from the tub along the detergent supply path, the buoyancy-type sealing member arranged in is moved along the detergent supply path by buoyancy to be supported by the protrusion and close the detergent supply path so as to prevent the back-flowed water from flowing through the detergent opening.

2. The washing machine of claim 1, wherein the buoyancy-type sealing member includes silicon.

3. The washing machine of claim 1, wherein
with water being supplied to the tub along the detergent supply path,
the buoyancy-type sealing member is moved away from the protrusion to open the detergent supply path.

4. The washing machine of claim 1, wherein the buoyancy-type sealing member includes a material movable by buoyancy in water.

5. The washing machine of claim 1, wherein
the detergent supplier includes:
a siphon tube protruding from a bottom side of the first detergent container and having a cavity formed in the siphon tube; and
a siphon cap arranged above the siphon tube and forming a siphon path together with the siphon tube.

6. The washing machine of claim 5, wherein the siphon cap includes a water-level adjustment lip that protrudes from an outer circumferential surface of the siphon cap.

7. The washing machine of claim 6, wherein the water-level adjustment lip is arranged at a height lower than a height of the siphon tube.

8. The washing machine of claim 5, wherein detergent stored in the detergent container is siphoned into the detergent supply path when a water level of water in the first detergent container is higher than a height of the siphon tube.

9. The washing machine of claim 5, wherein the buoyancy-type sealing member is arranged in a first detergent supply hose connecting the first detergent container cover and the tub.

10. The washing machine of claim 1, further comprising:
a guide member configured to guide movement of the buoyancy-type sealing member.

11. The washing machine of claim 10, wherein
the guide member includes:
a first support lip, and
a second support lip, and
the first support lip and the second support lip are configured to,
with water being supplied to the tub along the detergent supply path,
the first support lip limits movement of the buoyancy-type sealing member in a direction that the water being supplied to the tub flows, and
the second support lip limits movement of the buoyancy-type sealing member in a direction perpendicular to the direction that the water being supplied to the tub flows.

* * * * *